US010745901B2

(12) United States Patent
Steyl

(10) Patent No.: US 10,745,901 B2
(45) Date of Patent: Aug. 18, 2020

(54) SYSTEM AND METHOD OF CONSTRUCTING A MULTI-STORY BUILDING UTILIZING MODULAR COMPONENTS

(71) Applicant: Johannes Steyl, Groveland, FL (US)

(72) Inventor: Johannes Steyl, Groveland, FL (US)

(73) Assignee: Steel Worx Solutions LLC, Groveland, FL (US)

( * ) Notice: Subject to any disclaimer, the term of this patent is extended or adjusted under 35 U.S.C. 154(b) by 0 days.

(21) Appl. No.: 16/422,596

(22) Filed: May 24, 2019

(65) Prior Publication Data

US 2020/0157795 A1 May 21, 2020

Related U.S. Application Data

(60) Provisional application No. 62/770,524, filed on Nov. 21, 2018.

(51) Int. Cl.
*E04B 1/19* (2006.01)
*E04B 1/24* (2006.01)

(52) U.S. Cl.
CPC ..... *E04B 1/24* (2013.01); *E04B 1/1903* (2013.01); *E04B 1/2403* (2013.01); *E04B 2001/246* (2013.01); *E04B 2001/2415* (2013.01); *E04B 2001/2418* (2013.01); *E04B 2001/2421* (2013.01); *E04B 2001/2451* (2013.01); *E04B 2001/2463* (2013.01)

(58) Field of Classification Search
CPC ..... E04B 1/1903; E04B 1/2403; E04B 2001/2406; E04B 2001/2415; E04B 2001/2418; E04B 2001/2451; E04B 2001/2454; E04B 2001/246; E04B 2001/2463; E04B 2001/2457; Y10T 403/55; Y10T 403/553
USPC ..... 52/656.2, 655.1, 236.3, 298, 849; 446/117, 124
See application file for complete search history.

(56) References Cited

U.S. PATENT DOCUMENTS 949,394 A * 2/1910 Daly ..... E04B 1/2403 403/173
1,555,847 A * 10/1925 Hudson ..... E04G 7/20 403/306
1,915,023 A * 6/1933 Lizaso ..... E04B 1/2403 52/648.1

(Continued)

*Primary Examiner* — Robert Canfield
(74) *Attorney, Agent, or Firm* — Jason T. Daniel, Esq.; Daniel Law Offices, P A

(57) ABSTRACT

A building structure system and method includes a plurality of columns each having a uniform shape and size, a plurality of baseplates, a plurality of sleeves, and a plurality of support beams each having a uniform shape and size. Each of the columns include protrusions a first distance from each end of the column. Each sleeve is sized to receive two columns vertically and to position the ends of the received columns together while the protrusions of each of the received columns engage both ends of the sleeve. Apertures on the columns, baseplates and sleeves align to receive connectors. Each of the uniform beams are positioned horizontally between the columns and are joined to a sleeve at both ends. When so positioned, the top end of the sleeve will extend above the beam and flooring material so as to receive another column after the flooring material has cured.

17 Claims, 8 Drawing Sheets

(56) References Cited

U.S. PATENT DOCUMENTS 3,304,683 A * 2/1967 Ferreira ..... E04B 2/58 52/764
3,462,021 A * 8/1969 Hawke ..... A47F 5/14 211/182
4,630,550 A * 12/1986 Weitzman ..... A47B 13/06 108/155
4,691,818 A * 9/1987 Weber ..... B65G 33/32 198/666
4,903,354 A * 2/1990 Yeh ..... A47C 19/022 403/292
5,199,919 A * 4/1993 Glickman ..... A63H 33/062 446/120
5,298,681 A * 3/1994 Swift ..... H02B 1/01 174/97
5,568,909 A * 10/1996 Timko ..... E04H 12/2261 248/519
6,151,851 A * 11/2000 Carter ..... E04B 1/24 52/236.3
6,219,989 B1 * 4/2001 Tumura ..... E04B 1/2403 52/274
6,336,620 B1 * 1/2002 Belli ..... E04F 11/1814 248/519
D521,361 S * 5/2006 Kish ..... D8/354
7,722,286 B2 * 5/2010 Heald ..... E04H 12/2269 40/612
9,004,439 B2 * 4/2015 Gross ..... E04H 12/2269 248/507
9,447,573 B2 * 9/2016 Schubert ..... E04B 1/24
10,179,991 B2 * 1/2019 Houghton ..... E04B 1/2403
10,316,508 B1 * 6/2019 Hendry ..... E04H 12/2269
2003/0041549 A1 * 3/2003 Simmons ..... E04B 1/2403 52/655.1
2006/0010825 A1 1/2006 Schubert
2008/0053020 A1 * 3/2008 Collins ..... E04B 1/24 52/282.4
2016/0097209 A1 * 4/2016 Angelo ..... E04G 23/0229 52/297
2017/0233996 A1 * 8/2017 Abernathy ..... E04B 1/2403 52/698
2017/0314254 A1 * 11/2017 Houghton ..... E04B 1/1912
2018/0245329 A1 * 8/2018 Yu ..... E04B 1/2403
2019/0323223 A1 * 10/2019 Theriot ..... E04B 1/40

* cited by examiner

SYSTEM AND METHOD OF CONSTRUCTING A MULTI-STORY BUILDING UTILIZING MODULAR COMPONENTS

CROSS-REFERENCE TO RELATED APPLICATIONS

This application claims the benefit of U.S. application Ser. No. 62/770,524 filed on 21 Nov. 2018, the contents of which are incorporated herein by reference.

TECHNICAL FIELD

The present invention relates generally to the construction of buildings, and more particularly to a system and method of constructing buildings utilizing modular components.

BACKGROUND

The statements in this section merely provide background information related to the present disclosure and may not constitute prior art.

When constructing any new building, there is a tremendous amount of architectural and engineering work that must be performed to ensure the building meets applicable safety standards and industry requirements. With particular regard to multi-story steel buildings, such as those utilized in the storage industry, engineers design the structure utilizing a plurality of vertical support columns each having different lengths, widths and load bearing capacities.

Upon approval of the building design, a factory must construct a multitude of different shaped and sized columns, which then must be delivered to the building construction site in the particular order in which they are to be used. Finally, each individual column must be placed at the specified location within the building and welded on-site. One example of the current state of the art includes U.S. Patent publication no. 2006/0010825, to Schubert.

Unfortunately, this process of design, delivery and construction results in most of these storage unit steel buildings taking several months to design and complete. Additionally, because each column must be welded on-site, and then inspected, there is a tremendous amount of costs associated with skilled labor that adds to the overall cost of the building. Moreover, because the columns are designed for use at particular locations within the building, it is not uncommon for some of the columns to be left sitting at the construction site for days or weeks until being installed.

Accordingly, it would be beneficial to provide a building system wherein each of the vertical columns comprise substantially identical shapes and sizes, and that do not need to be welded on-site so as to eliminate each of the drawbacks described above.

SUMMARY OF THE INVENTION

The present invention is directed to a system and method of constructing a building structure using modular components. One embodiment of the present invention can include a plurality of columns each having a uniform shape and size, a plurality of baseplates, a plurality of sleeves, and a plurality of support beams each having a uniform shape and size.

In one embodiment, each of the columns include protrusions that are disposed a set distance from each end of the column, each of the protrusions are configured to engage the outer edge of a sleeve or baseplate that is connected to the respective end of the column.

In one embodiment, the sleeves are sized to receive two columns vertically and to position the ends of the received columns together while the protrusions of each of the received columns engage both ends of the sleeve. Apertures located along the sleeves and columns are aligned and can receive a connector.

Each of the uniform beams are positioned horizontally between the columns and are joined to a sleeve at both ends. When so positioned, the top end of the sleeve will extend above the beam and flooring material so as to receive another column after the flooring material has cured.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
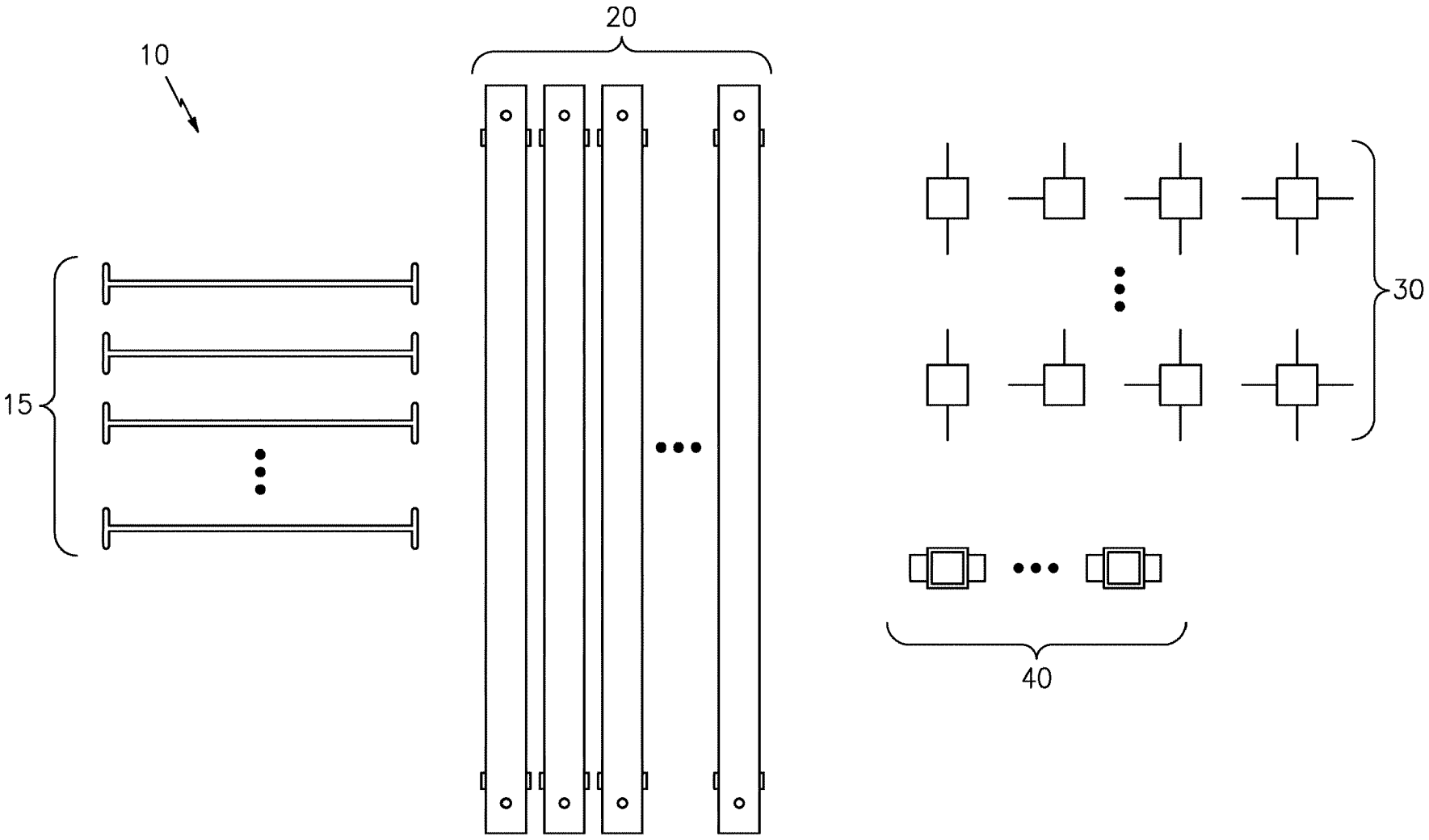
FIG. 1 illustrates one embodiment of a building structure system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "uniform shape" and "uniform size" shall be used to describe components whose shape and size are identical, or substantially identical within a tolerance such as, for example, manufacturing tolerances, measurement tolerances or the like.

As described throughout this document, the term "complementary shape," and "complementary dimension," shall be used to describe a shape and size of a component that is substantially identical to the shape and size of another identified component within a tolerance such as, for example, manufacturing tolerances, measurement tolerances or the like.

FIGS. 1-10 illustrate one embodiment of a system and method of constructing a multi-story building utilizing modular components 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 5.

As shown in FIG. 1, the building structure system 10 can include a plurality of uniform beams 15, a plurality of uniform columns 20, a plurality of sleeves 30 and a plurality of baseplates 40.

As will be described below, each of the floor beams 15 can be positioned horizontally during the building construction. In various embodiments each of the beams can comprise elongated wide flange steel beams having a I-beam profile, but there is nothing within the spirit and scope of the present invention limiting these structural members to this type of beam. In the preferred embodiment, each of the beams will include a uniform shape and size that is of sufficient strength to withstand the load demands placed on them by the weight of building and any external forces acting thereon.

As will be described below, each of the columns 20 can be positioned vertically during the building construction. In various embodiments each of the columns can comprise uniformly shaped and sized elongated steel members having an I-beam profile. Of course, other embodiments are contemplated wherein the columns 20 can be constructed from other materials and/or can include other uniform shapes such as a cylindrical profile, for example, that are of sufficient strength to withstand the load demands placed on them by the weight of building and any external forces acting thereon. In such situations, the described sleeves and baseplates will include complementary shapes as the column, so as to receive the same in the manner described below.

Figure 2:
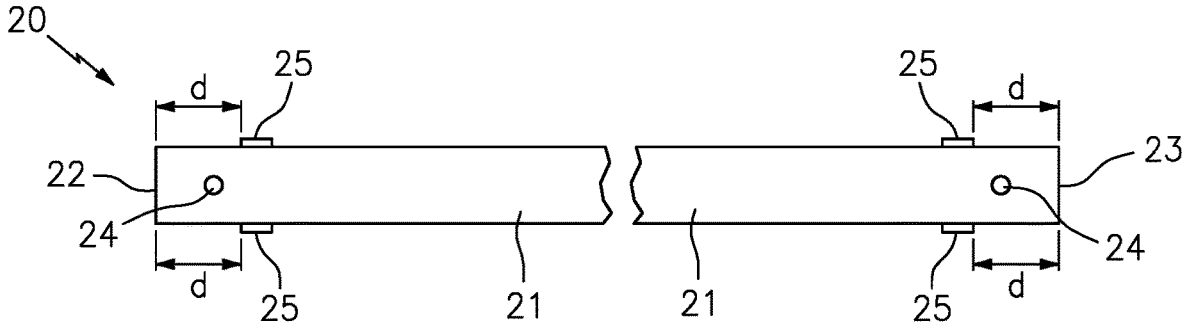
FIG. 2 is a side view of a uniform column of the system, in accordance with one embodiment of the invention.
Figure 3:
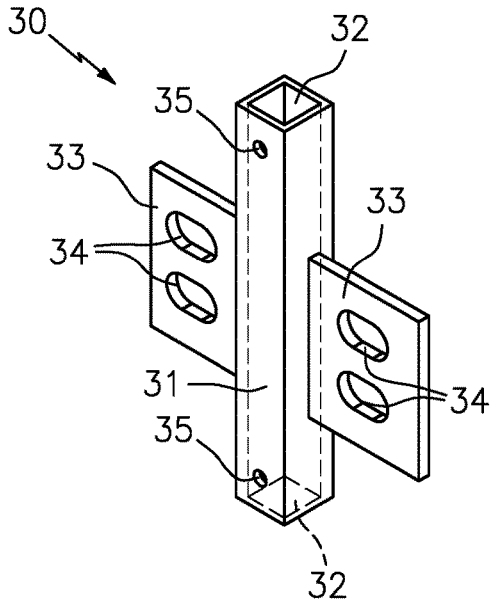
FIG. 3 is a perspective view of a sleeve of the system, in accordance with one embodiment of the invention.
Figure 4:
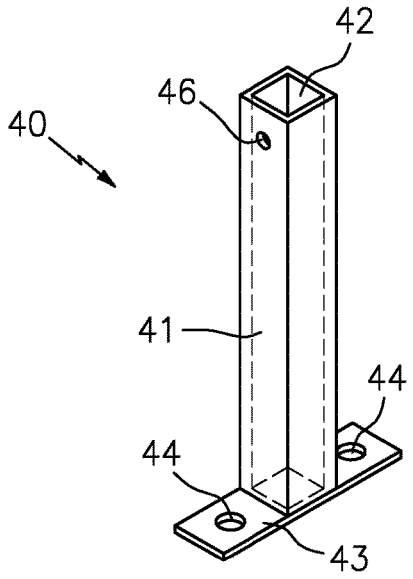
FIG. 4 is a perspective view of a baseplate of the system, in accordance with one embodiment of the invention.

As shown best in FIG. 2, each column 20 can include an elongated main body member 21 having a flat first end 22, a flat second end 23, a pair of apertures 24 and protrusions 25 extending outward from the main body. In one embodiment each column can include at least two protrusions located along each of the proximal and distal ends. Each of the protrusions can be positioned along opposite sides of the main body at a first distance d from the respective end.

In the preferred embodiment, each of the protrusions 25 can comprise generally rectangular shaped pieces of one-half inch thick steel stock having a leading edge that is perpendicular to the major axis of the column. Each of the protrusions preferably being welded onto the main body 21 at a time of manufacture or any other time prior to being shipped to the building construction site.

In this regard, it is noted that previous methodologies that relied on on-site welding are performed under a process called shielded metal arc welding (SMAW), wherein the worker uses a less robust form of arc welding, must often reach overhead to engage the area, and must do so in an outdoor environment under less than optimal conditions. This system provides that building structure welds are spot checked by a welding inspector but not every weld is actually checked.

Conversely, under the present system each of the welds can be performed at a certified welding fabricator using a process called dual shield Flux-covered arc welding (FCAW) in optimal conditions. Such a process ensures that each weld is individually inspected and logged, thereby providing traceability records that can be easily searched in the event of a building collapse or other instance where such information would be useful.

Although described above as including a particular number of protrusions each having a specific shape, size and location, this is for illustrative purposes only. To this end, other embodiments are contemplated wherein any number of protrusions can be positioned along each end of each column. The protrusions may be constructed from any number of other construction materials, shapes, thicknesses and sizes, and may be secured to the column body utilizing other known construction methodologies.

Each of the sleeves 30 can function to join a pair of columns together vertically and can also engage one or more of the support beams. As shown best at FIG. 3, each of the sleeves 30 can include an elongated hollow central body 31 having a pair of openings 32 at each end. The central body and openings having a shape and cross-sectional dimension that is complementary to the shape and cross sectional dimension of the uniform columns 20. Each of the sleeves can also include one or more generally planar clips 33 that can extend outward from the central body 30. Each of the clips can include apertures 34 for receiving a bolt that secures a support beam 15 to the clip. Each sleeve can include up to four clips for supporting up to four beams in any number of different orientations (See FIG. 1). Each sleeve can also include a pair of apertures 35 along the central body. Each of the apertures 34 including a complementary location to apertures 24 of the columns.

Each of the baseplates 40 can function to secure one end of a column 20 to the ground. As shown best at FIG. 4, each of the baseplates can include an elongated hollow central body 41 having an opening 42 at one end. The central body and opening will also have a shape and cross-sectional dimension that is complementary to the shape and cross sectional dimension of the uniform columns 20. The second end of the central body can terminate onto an elongated flat plate 43 that extends outward therefrom. The plate can include apertures 44 for receiving anchors that secure the baseplate to the ground, and column apertures 46 that are positioned complementary to the location of the apertures 24 along each end of the columns.

In the preferred embodiment, each of the columns can include a length (e.g., distance between the proximal and distal ends) of approximately 10 feet, and the first distance d can be approximately 1 foot. The 10 foot length of the columns being sufficient to ensure the building has a finished ceiling height of at least 8 feet. Likewise, each of the beams 15 can include a length of approximately 10 feet. Such dimensions functioning to create a 10 ft by 10 ft grid, which is particularly advantageous for use in storage buildings, where uniform grids allow for even spacing and distribution of rentable units.

In the preferred embodiment, each of the sleeves 30 can include a longitudinal length (e.g., between the openings 32) of 2 feet. Such a dimension ensures that the flat ends 22/23 of two individual columns positioned within a single sleeve will be in direct contact with each other, while simultaneously ensuring the entire leading edge of each of the protrusions 25 that are spaced 1 foot from the end of the columns are in direct contact with the edge of the sleeve body.

In the preferred embodiment, each of the baseplates 40 can include a longitudinal length (e.g., between plate 43 and opening 42) of 1 foot. Such a dimension ensures that the flat end of a column positioned within the baseplate will be in direct contact with the top of the plate 43, while simultaneously ensuring the entire leading edge of each of the protrusions 25 are in direct contact with the edge of the baseplate body.

Although described above as including specific dimensions, this is for illustrative purposes only. To this end, each of the above noted components can include any number of other dimensions.

Figure 5:
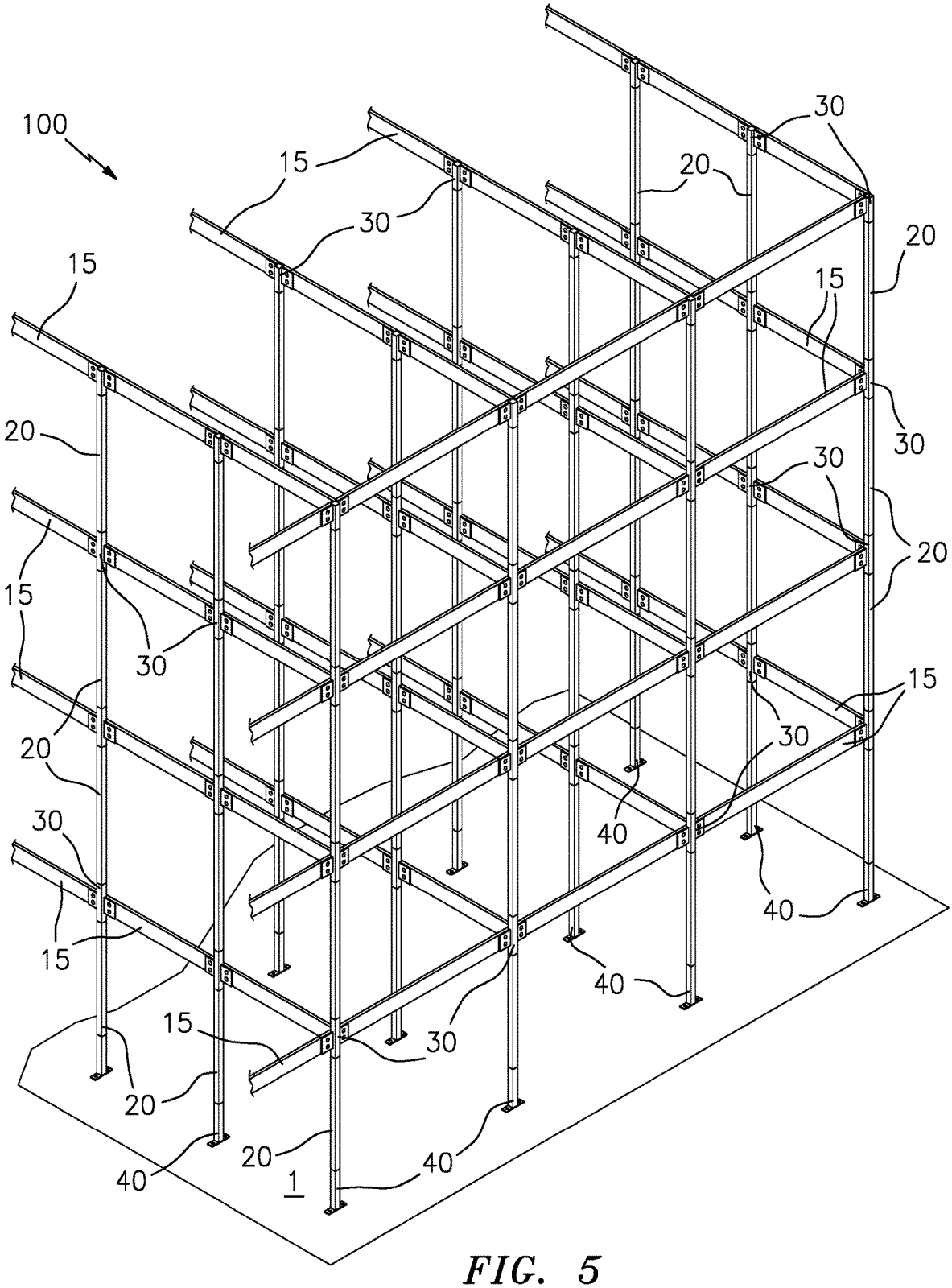
FIG. 5 is a perspective partial section view of a building structure system, in accordance with one embodiment of the invention.
Figure 6:
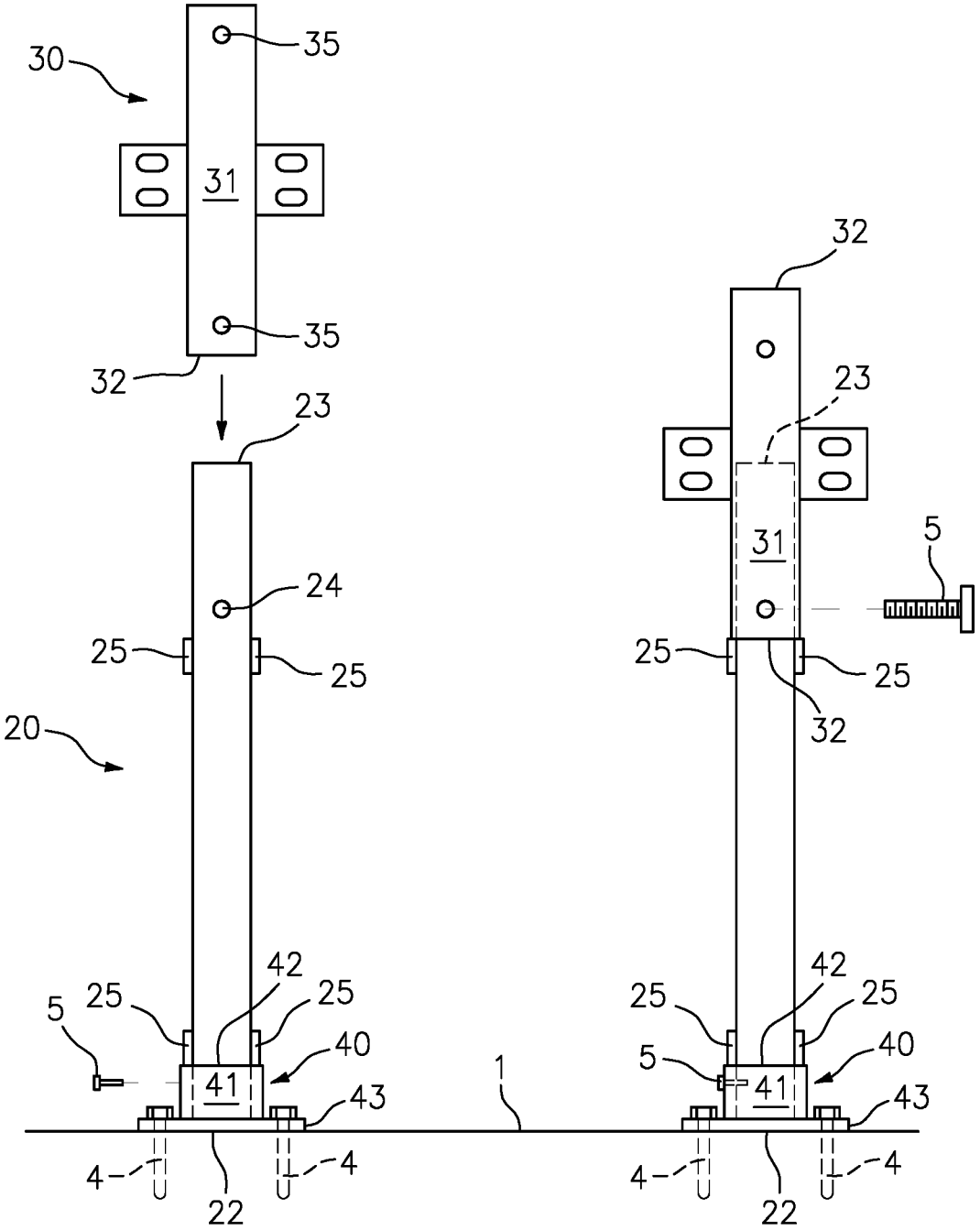
FIG. 6 is a side view of the building structure system in operation, in accordance with one embodiment of the invention.

FIG. 5 illustrates one embodiment of a building structure 100 that is constructed utilizing the above noted system components 10. As shown, the building can include a plurality of baseplates 40 that are arranged on a common foundation 1. The foundation 1 can preferably comprise a concrete load-bearing foundation, but other foundation types may be employed without departing from the present invention.

As shown, a plurality of uniform columns 20 can be anchored to the foundation 1 by the baseplates 40 and extend upward therefrom. Sleeves 30 are positioned along the distal ends of each column 20 and function to support the horizontal beams 15 that form each floor of the building. Any number of subsequent floors can be constructed by placing additional vertical columns 20 into the top of the prior-floor's sleeves 30, and by providing additional horizontal beams 15. At this time, a roof, sidewalls and other such components can be provided in the customary fashion.

FIGS. 6-10 illustrate one embodiment of a building construction method utilizing the modular system 10. As noted above, construction of the building 100 begins with a plurality of uniform columns 20 that are affixed to and supported by a foundation 1 by baseplates 40. To this end, each baseplate 40 can be secured to the ground 1 utilizing ground penetrating anchors 4 such as screw anchors, or other known devices for example, that are positioned through the baseplate apertures.

Once the baseplate is secured to the ground, the bottom end 22 of a column 20 can be positioned within the open end 42 of the baseplate until the leading edge of the protrusions 25 engage the outer edge of the baseplate body 41. When so positioned, the entire flat bottom end 22 of the column 20 will be in contact with the flat surface of the plate 43, and apertures 46 and 22 will be aligned so as to receive a bolt 5 or other such connector.

In this regard, it is specifically noted that the engagement of the protrusions 25 with the baseplate provide the necessary structural support for allowing the assembly to receive and transfer vertical loads to the ground. As a result, the system advantageously does not require a worker to weld each column to the associated baseplate.

Next, a sleeve 30 can be positioned above the columns and the upper end 23 of each column can be slid into one of the sleeve openings 32 until the leading edge of the protrusions 25 engage the outer edge of the sleeve body 31. When so positioned, the upper end 23 of the column will be located midway along the length of the sleeve, and apertures 35 and 22 will be aligned so as to receive a bolt 5 or other such connector.

Figure 7:
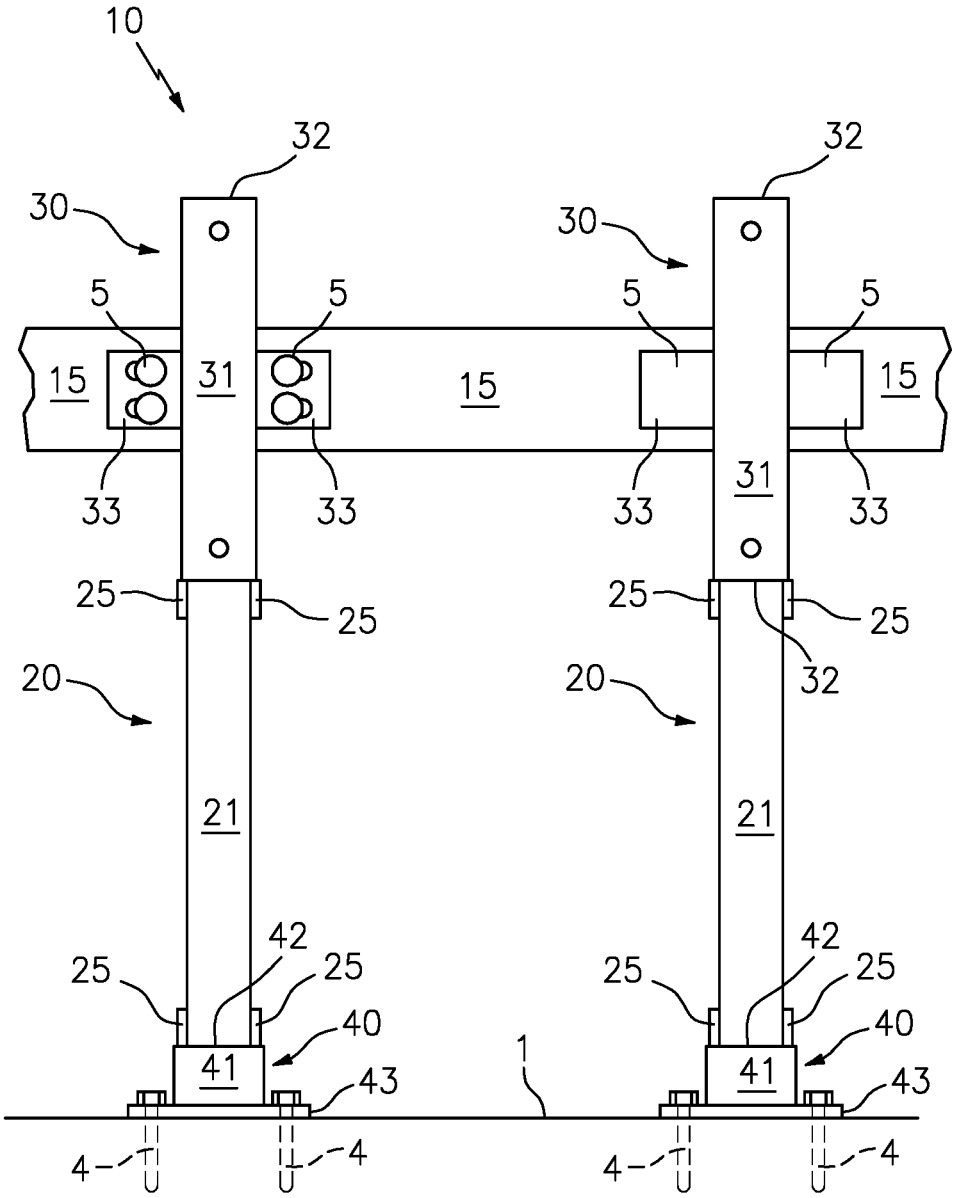
FIG. 7 is another side view of the building structure system in operation, in accordance with one embodiment of the invention.

As shown at FIG. 7, once the sleeves 30 have been positioned onto the top of the columns 20, floor beams 15 can be suspended horizontally between the columns. In this regard, each end of every beam 15 can be placed against one of the planar clips 33 and secured thereto via additional connectors 5 such as threaded fasteners or rivets, for example.

Figure 8:
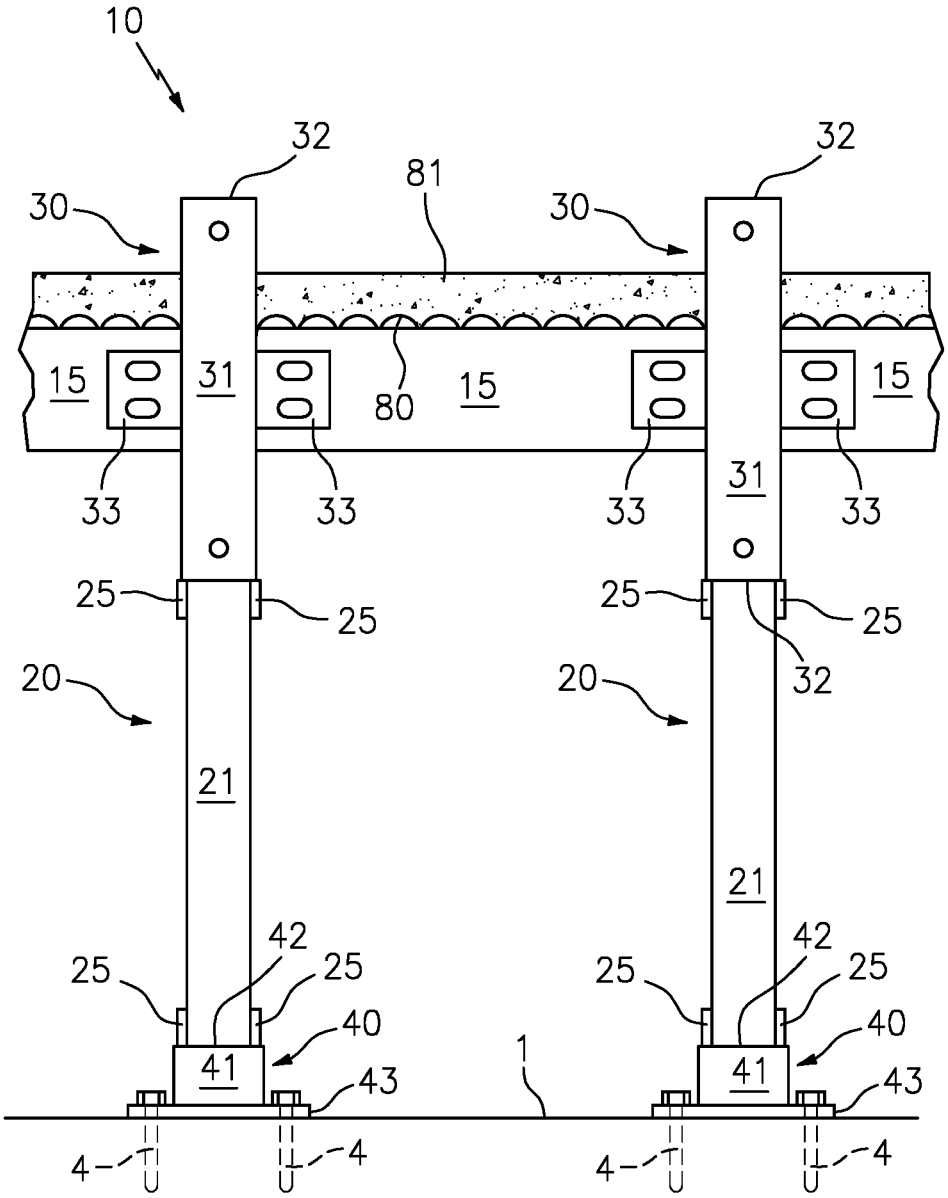
FIG. 8 is another side view of the building structure system in operation, in accordance with one embodiment of the invention.

As shown at FIG. 8, sheet metal panels 80 can be positioned along the top of the beams 15. The panels can be positioned so as to engage the sides of the sleeves 30 which extend upward approximately 3-6 inches feet from the top surface of each of the beams 15. Next, an upper floor surface such as a concrete slab 81, for example, can be poured on the top of the sheet metal panels 80 to form the floor surface. As noted above, because the sleeves are not flush with the floor, the concrete slab 81 is poured around the sleeve body, and the aperture 35 is exposed.

Figure 9:
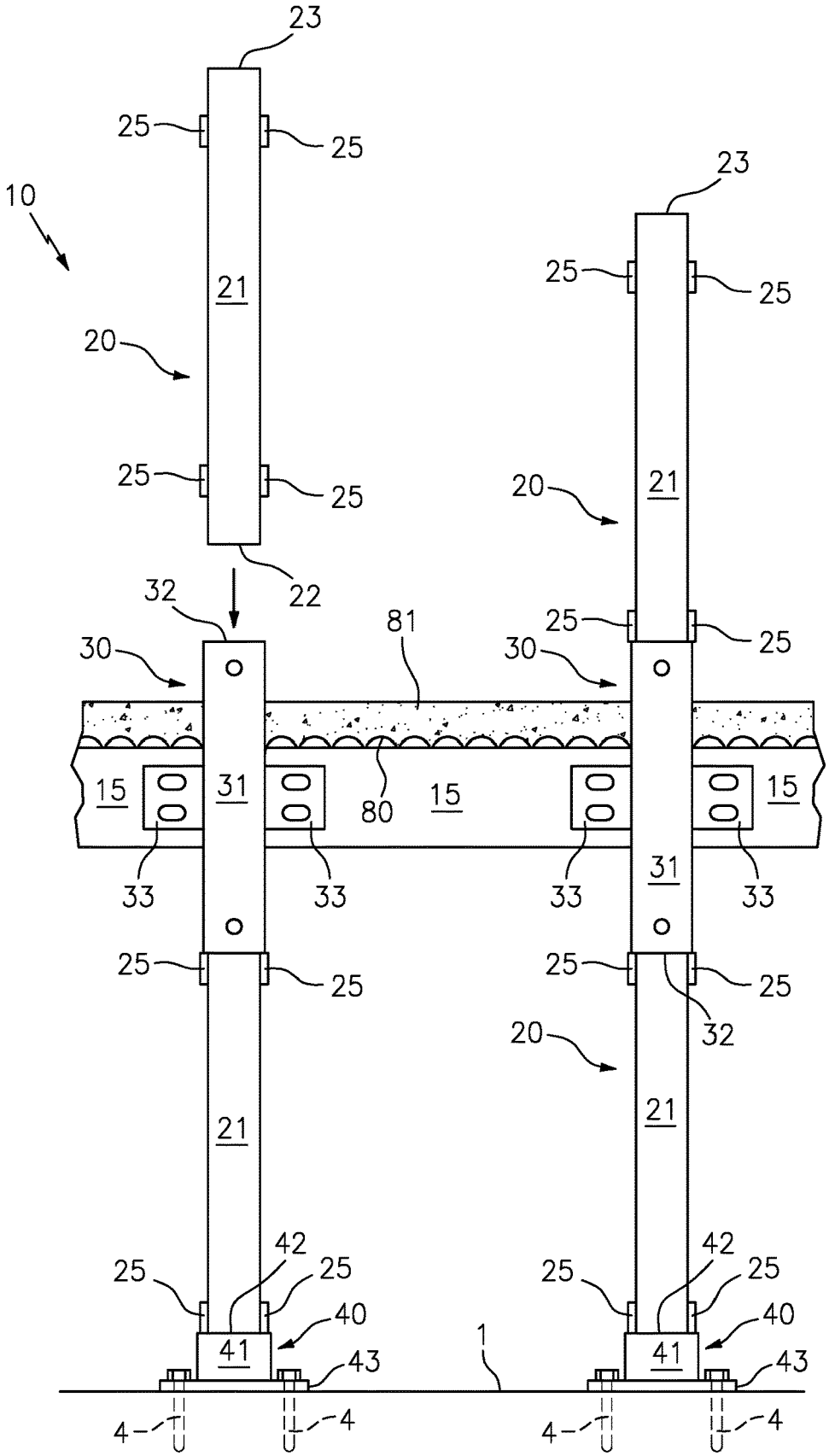
FIG. 9 is another side view of the building structure system in operation, in accordance with one embodiment of the invention.

As shown at FIG. 9, after the concrete slab 81 for a given floor has cured, additional columns 20 can be provided. In this regard, the bottom end 22 of each new column 20 can be positioned within the open top end 32 of a sleeve 30 until the leading edge of the protrusions 25 engage the outer edge of the sleeve body 31. At this time, the upper half of the sleeve is positioned above the floor and the apertures 35 and 24 are aligned and fully exposed. This design advantageously allows a worker to secure a bolt 5 or other such connector to stabilize the column until the next floor is assembled. Such a feature replaces the previous need for welding at this step, and the process can be repeated until the desired number of building floors are constructed.

Figure 10:
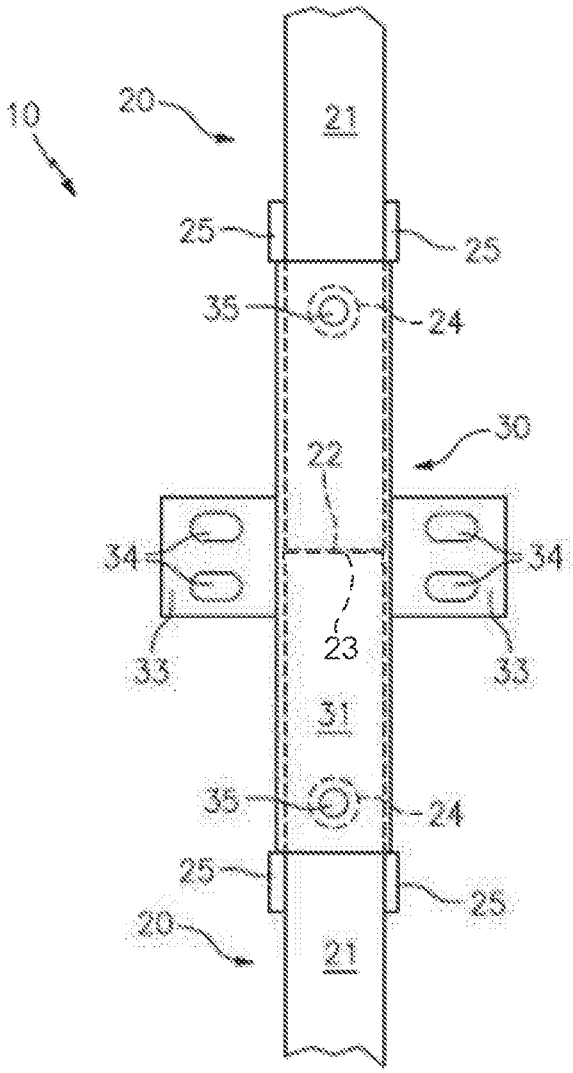
FIG. 10 is a side detail view of the building structure system in operation, in accordance with one embodiment of the invention.

As shown at cutout FIG. 10, when two vertical columns 20 are positioned within a sleeve 30, the entire bottom end 22 of the upper column will be in direct contact with the entire top end 23 of the lower column, and each of the protrusions 25 of both columns will be secured against the body of the sleeve 31. In this regard, it is specifically noted that the engagement of the protrusions 25 with the sleeve body provide the necessary structural support for allowing the assembly to receive and transfer vertical weight loads downward to the ground. As a result, the system advantageously does not require a worker to weld each column to the associated sleeve.

Accordingly, the above described system and method can utilize a plurality of uniform modular components (e.g., columns, beams, sleeves and baseplates) to construct buildings having any number of different sizes and floors. Moreover, by providing pre-welded protrusions onto each column, the building components are interchangeable and can be assembled on-site without requiring time consuming welds and inspections of the same.

As described herein, one or more elements of the system 10 can be secured together utilizing any number of known attachment means such as, for example, screws, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A building structure system, comprising:

a plurality of columns each having a first end, a second end, a first aperture, and a second aperture;

a plurality of protrusions that are positioned along each end of the plurality of columns;

a plurality of baseplates that are each configured to secure the first end of one of the plurality of columns to a ground surface;

a plurality of sleeves, that are configured to engage each of the plurality of protrusions, and to secure a first end of one of the plurality of columns to a second end of another of the plurality of columns in a vertical orientation;

a plurality of connectors, each of the plurality of connectors being configured to engage one of the plurality of columns and one of the plurality of sleeves or one of the plurality of baseplates; and a plurality of support beams each having a first end and a second end, wherein each of the plurality of support beams are configured to be secured horizontally between two of the plurality of sleeves, and wherein the plurality of sleeves, the plurality of protrusions and the plurality of connectors function together permanently secure the one column to the one sleeve or the one baseplate in a weld free manner.

2. The system of claim 1, each of the plurality of protrusions comprise pre-welded protrusions extending outward perpendicularly from a major axis of a respective column, and being configured to engage one of the plurality of sleeves or one of the plurality of baseplates.

3. The system of claim 2, wherein each of the sleeves comprise:

an elongated hollow main body having a first open end, a second open end, and a middle portion, said first open end and second open end each including an inside shape and size that is complementary to an outside shape and size of one end of each of the plurality of columns; and at least one planar clip that extends outward perpendicularly from the middle portion of the main body, said clip including apertures for receiving a bolt to engage one of the plurality of support beams.

4. The system of claim 3, wherein each of the sleeves including dimensions for receiving two of the plurality of columns so that the first end of one of the received columns is in direct contact with the second end of the other received column, and the pre-welded protrusions of each of the received columns are in contact with the hollow main sleeve body.

5. The system of claim 4, further comprising: a pair of apertures that are positioned along the main body of each sleeve, wherein each of the apertures positioned along a respective sleeve align with one of the pair of apertures boated on each of the received columns and are configured to receive one of the plurality of connectors.

6. The system of claim 4, wherein said dimensions include a length that is suitable for positioning the first end of each of the plurality of sleeves above a poured floor of a building being constructed.

7. The system of claim 6, further comprising:

a first aperture that is positioned along the first end of each of the plurality of sleeves, wherein said dimensions include a length that is suitable for positioning the first aperture of each of the plurality of sleeves above the poured floor of the building being constructed.

8. The system of claim 7, wherein said dimension comprises a length of two feet.

9. The system of claim 2, wherein each of the protrusions include a planar leading edge that is positioned a first distance from the end of the respective column, and each of the protrusions extend outward from the column at least 0.5 inches.

10. The system of claim 2, wherein each of the baseplates comprise:

an elongated hollow central body having a flat bottom end, a middle section, an open top end, and an aperture located along the middle section, said open top end including an inside shape and size that is complementary to an outside shape and size of one end of each of the plurality of columns; and an elongated flat plate that extends outward perpendicularly from the bottom end, said plate including apertures for receiving a ground anchor.

11. The system of claim 10, wherein the baseplate includes dimensions for receiving one of the plurality of columns so that the first end of the received column is in direct contact with the flat bottom end, and the protrusions of the received column are in contact with the hollow central body.

12. The system of claim 11, wherein the aperture located on the baseplate aligns with one of the apertures located on the received column, and the aligned apertures are configured to receive a connector.

13. The system of claim 2, wherein each weld of the pre-welded protrusions are inspected and logged to create a traceability record.

14. The system of claim 1, wherein each column of the plurality of columns has an identical shape and an identical length as every other column.

15. The system of claim 14, wherein each column is configured to be positioned on any floor of a building being constructed.

16. The system of claim 1, wherein each support beam of the plurality of support beams has an identical shape and an identical length as every other support beam.

17. The system of claim 16, wherein each support beam is configured to be positioned on any floor of a building being constructed.

* * * * *